US012114742B2

(12) United States Patent
Francis

(10) Patent No.: US 12,114,742 B2
(45) **Date of Patent: *Oct. 15, 2024**

(54) UMBRELLA DOLLY

(71) Applicant: Mitchell J. Francis, Beverly Hills, CA (US)

(72) Inventor: Mitchell J. Francis, Beverly Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/476,084

(22) Filed: Sep. 27, 2023

(65) Prior Publication Data

US 2024/0108108 A1 Apr. 4, 2024

Related U.S. Application Data

(60) Provisional application No. 63/378,163, filed on Oct. 3, 2022.

(51) Int. Cl.
*A45B 23/00* (2006.01)
*A45B 17/00* (2006.01)

(52) U.S. Cl.
CPC ..... *A45B 23/00* (2013.01); *A45B 17/00* (2013.01); *A45B 2023/0006* (2013.01)

(58) Field of Classification Search
CPC ..... A45B 2023/0006; A45B 23/00; E04H 12/2238
See application file for complete search history.

(56) References Cited

U.S. PATENT DOCUMENTS 3,117,655 A * 1/1964 Skupas ..... B62B 5/0423 188/111
3,320,703 A 5/1967 Hawthorn et al.
3,734,527 A 5/1973 Bard
3,841,631 A * 10/1974 Dolan ..... A63B 71/023 473/481
4,378,191 A 3/1983 Sato
5,060,907 A * 10/1991 Castano ..... F16M 11/08 248/536
5,927,514 A 7/1999 Linder
5,934,863 A 8/1999 Beck
6,135,467 A 10/2000 Tagariello
6,367,494 B1 * 4/2002 Tung ..... E01F 9/662 135/48
6,419,246 B1 7/2002 Neal
6,869,058 B2 * 3/2005 Tung ..... E04H 12/2238 248/910
7,347,428 B2 * 3/2008 Edenso ..... A01G 9/02 248/128

(Continued)

FOREIGN PATENT DOCUMENTS

CH 682975 A5 12/1993
CN 201513683 U 6/2010

(Continued)

*Primary Examiner* — Noah Chandler Hawk
(74) *Attorney, Agent, or Firm* — Welsh Flaxman & Gitler LLC

(57) ABSTRACT

An umbrella dolly for use with a cantilever umbrella includes a platform assembly and a retention assembly constructed to extend between the platform assembly and the umbrella. The retention assembly provides additional support and ensures that the umbrella and platform assembly are securely connected to enhance stability of the umbrella as it sits upon the umbrella dolly.

31 Claims, 7 Drawing Sheets

(56) References Cited

U.S. PATENT DOCUMENTS

| | | | | |
|---|---|---|---|---|
| 7,845,656 | B2 | 12/2010 | Thompson | |
| 8,029,006 | B2 | 10/2011 | Kalajyan | |
| 8,256,778 | B1 | 9/2012 | Morad et al. | |
| 8,657,246 | B2 | 2/2014 | Ma | |
| 8,833,709 | B2 | 9/2014 | Weng | |
| 8,910,957 | B1 | 12/2014 | Hassell | |
| 8,960,625 | B2 * | 2/2015 | Ma | F16H 21/54 248/346.11 |
| 9,192,266 | B2 | 11/2015 | Starr et al. | |
| 9,358,995 | B2 | 6/2016 | Allos et al. | |
| 10,017,955 | B2 * | 7/2018 | Ye | A45B 23/00 |
| 10,100,969 | B1 | 10/2018 | Zhu et al. | |
| 10,286,943 | B1 | 5/2019 | Greenblatt et al. | |
| D866,949 | S | 11/2019 | Siegenthaler | |
| 10,711,481 | B2 | 7/2020 | Zhu et al. | |
| 10,813,425 | B2 | 10/2020 | Shen et al. | |
| 10,857,930 | B1 | 12/2020 | Levi | |
| 11,260,992 | B1 | 3/2022 | Wiskus | |
| 11,629,520 | B1 * | 4/2023 | Geraghty | A45B 23/00 280/35 |
| 2001/0024026 | A1 | 9/2001 | Knutsson | |
| 2003/0002968 | A1 | 1/2003 | Nance | |
| 2004/0123887 | A1 | 7/2004 | Naber | |
| 2005/0002767 | A1 | 1/2005 | Oosterhouse | |
| 2005/0036870 | A1 | 2/2005 | Johansen | |
| 2005/0205727 | A1 | 9/2005 | Nerger | |
| 2006/0054206 | A1 * | 3/2006 | Bilotti | A45B 11/00 248/129 |
| 2017/0114563 | A1 | 4/2017 | Ye | |
| 2018/0212414 | A1 * | 7/2018 | Behr | E04H 12/18 |
| 2019/0376307 | A1 * | 12/2019 | Zhu | A45B 25/00 |
| 2020/0015557 | A1 * | 1/2020 | Shen | A45B 25/02 |

FOREIGN PATENT DOCUMENTS

| | | | |
|---|---|---|---|
| CN | 216636588 | U | 5/2022 |
| EP | 1692933 | A1 | 2/2006 |
| NZ | 234624 | A | 1/1993 |

* cited by examiner

FIG. 7
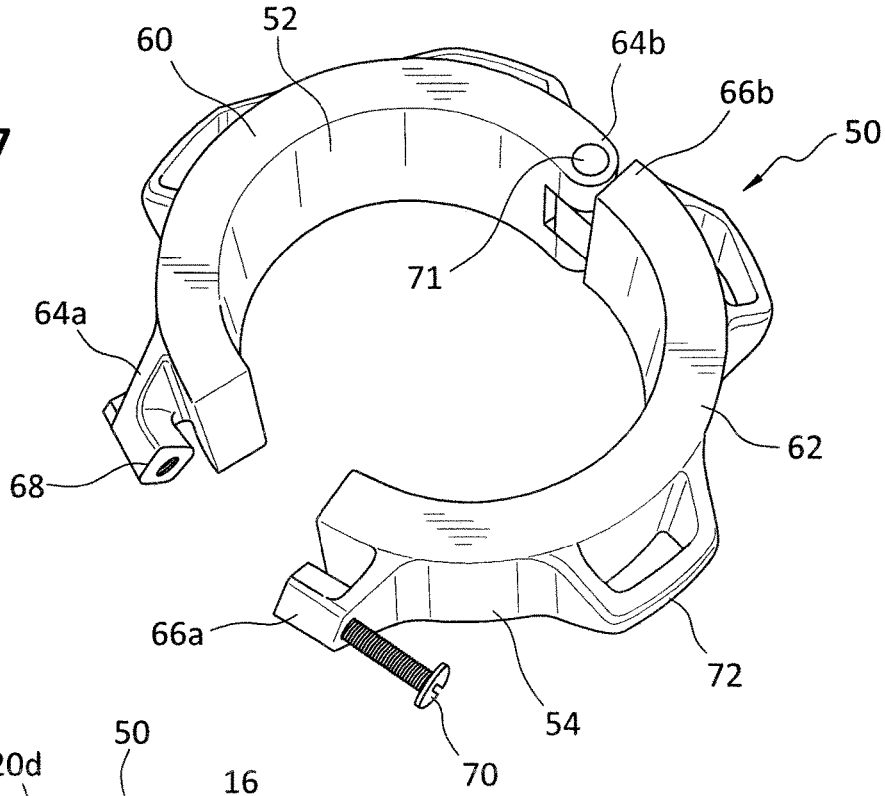
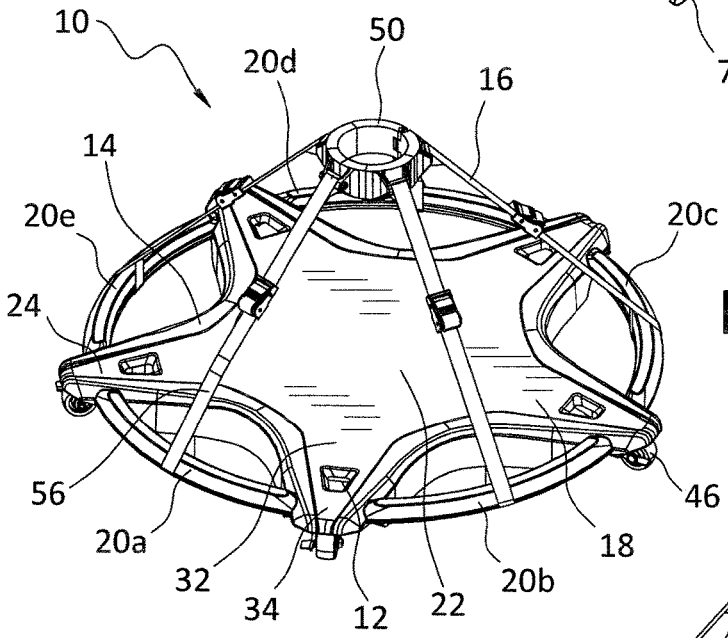
FIG. 8
FIG. 9
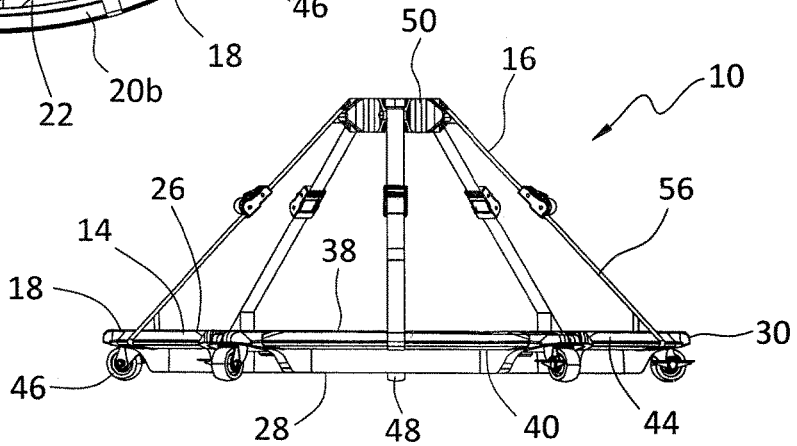

UMBRELLA DOLLY

CROSS REFERENCE TO RELATED APPLICATION

This application claims the benefit of U.S. Provisional Application Ser. No. 63/378,163, entitled "UMBRELLA DOLLY," filed Oct. 3, 2022, which is incorporated herein by reference.

BACKGROUND OF THE INVENTION

1. Field of the Invention

The present invention relates to an umbrella dolly.

2. Description of the Related Art

For the past twenty years, several companies such as Frontgate, Costco, Target, and home stores have sold hundreds of thousands of shade umbrellas that typically feature a diameter of between 11 and 13 feet. These umbrellas are cantilevered (side mount) and usually rotate 360 degrees around a fixed base. The base is commonly filled with 250 to 400 pounds of sand, water, or concrete (which allowed to dry into a concrete block within the base) by the customer during installation in their yard.

Cantilevered umbrellas are fantastic but have one very significant problem: they are stuck in the same spot for life. Portability would add tremendous value and utility for the customer. Being able to move the umbrella to wherever people are gathering would greatly add to the value and enjoyment of these expensive umbrellas. Further, being able to move the umbrella out of the way or for events, storage and cleaning are great advantages.

There are many wheeled umbrella bases for standard center-pole umbrellas and there are a couple of wheeled bases for cantilevered umbrellas. However, there are no wheeled platforms or dollies to go underneath the weighted umbrella base—and certainly no products with tie-down systems to help prevent tipping, pull-outs, and wind spin.

SUMMARY OF THE INVENTION

In one aspect an umbrella dolly for use with a cantilever umbrella includes a platform assembly and a retention assembly constructed to extend between the platform assembly and the umbrella. The retention assembly provides additional support and ensures that the umbrella and platform assembly are securely connected to enhance stability of the umbrella as it sits upon the umbrella dolly.

In some embodiments the platform assembly includes a central support platform.

In some embodiments the central support platform includes a plurality of downwardly extending lockable caster wheels secured to the lower surface thereof.

In some embodiments at least one nonlocking swivel caster wheel is secured to the lower surface of the central support platform.

In some embodiments the central support platform includes an upper surface, a lower surface, and a sidewall extending between the upper surface and the lower surface.

In some embodiments the central support platform is of a one-piece construction.

In some embodiments the central support platform includes a substantially circular central portion from which a plurality of support arms, which have a triangular shape, extend.

In some embodiments each of the plurality of support arms includes a wide first end coextensive with a central portion and a narrow second end at an apex of a triangle defined by the respective support arms.

In some embodiments the respective ends of each anchoring member are coextensive with side walls of respective support arms adjacent a second end thereof.

In some embodiments the central support platform includes five support arms.

In some embodiments the central support platform includes a series of anchoring members for engagement with the retention assembly.

In some embodiments each of the anchoring members includes an upper surface and a lower surface, wherein the upper and lower surfaces are connected by an interior side wall and an exterior side wall.

In some embodiments the anchoring members are arcuate anchoring members extending between support arms of the central support platform, the arcuate anchoring members provide an anchoring point for attachment of straps of the retention assembly.

In some embodiments the retention assembly includes a collar member shaped and dimensioned for secure attachment to an upwardly extending pole of the umbrella in an area adjacent to a base of the umbrella and the platform assembly.

In some embodiments the collar member is annular and includes an inner surface that directly engages the pole of the umbrella and an outer surface facing away from the pole of the umbrella.

In some embodiments the collar member includes arcuate first and second collar segments, each of the first and second collar segments is provided with opposed end members that mate with respective end members of the other collar segment when the first and second collar segments are positioned about the pole of the umbrella.

In some embodiments the retention assembly further includes straps and D-rings are secured to the outer surface of the first and second collar segments to provide a mounting structure for the straps of the retention assembly.

In some embodiments the retention assembly further includes a plurality of straps extending from an outer surface of the collar member.

In some embodiments each of the plurality of straps includes a first end secured to the collar member and a second end adapted for attachment to, and adjustment relative to, the platform assembly.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 7 is a perspective view of the collar member.

FIGS. 8, 9, 10, and 11 are respectively a perspective view, a side view, a bottom view, and a top view of the umbrella dolly.

DESCRIPTION OF THE PREFERRED EMBODIMENTS

Figure 1:
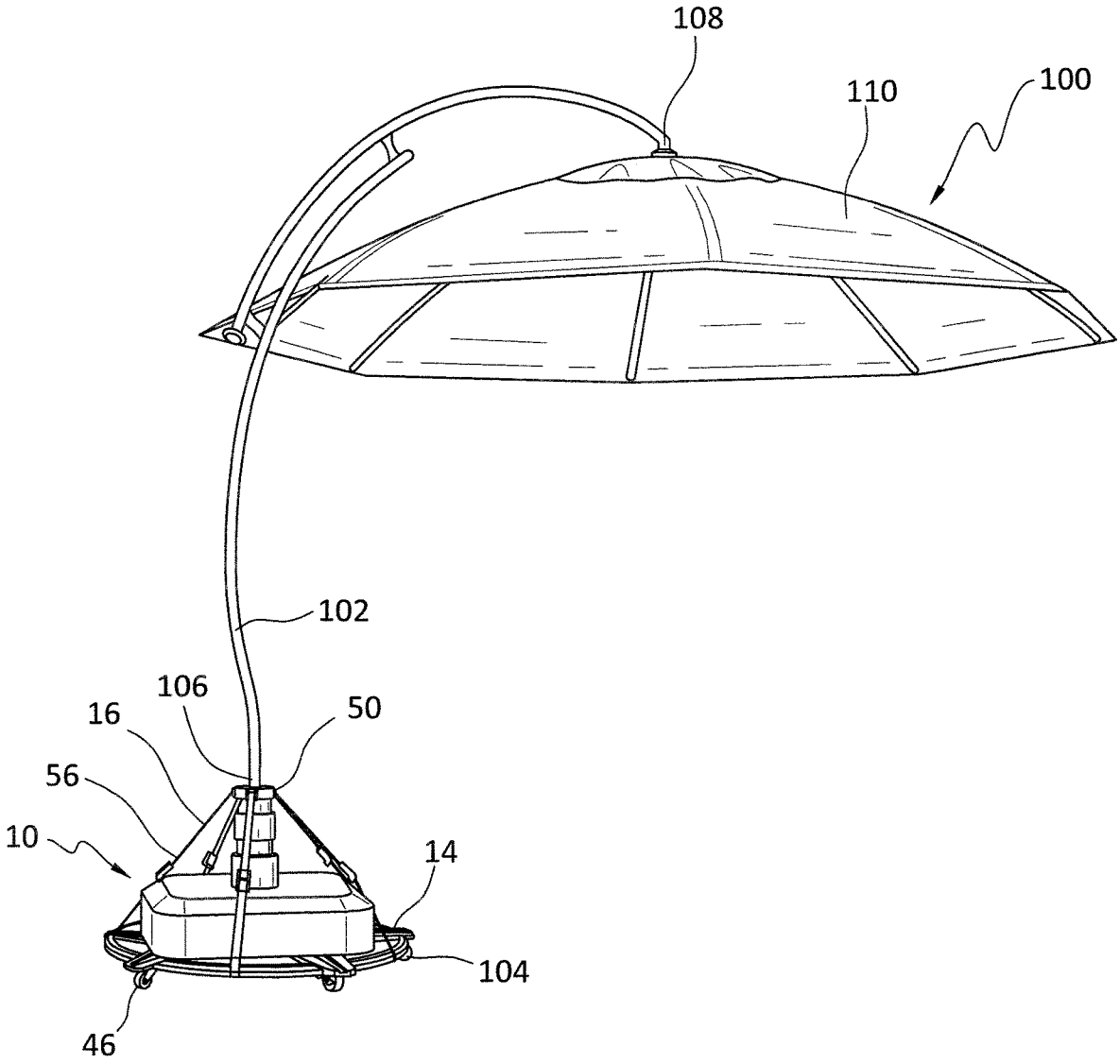
FIG. 1 is a left perspective view of the umbrella dolly.
Figure 2:
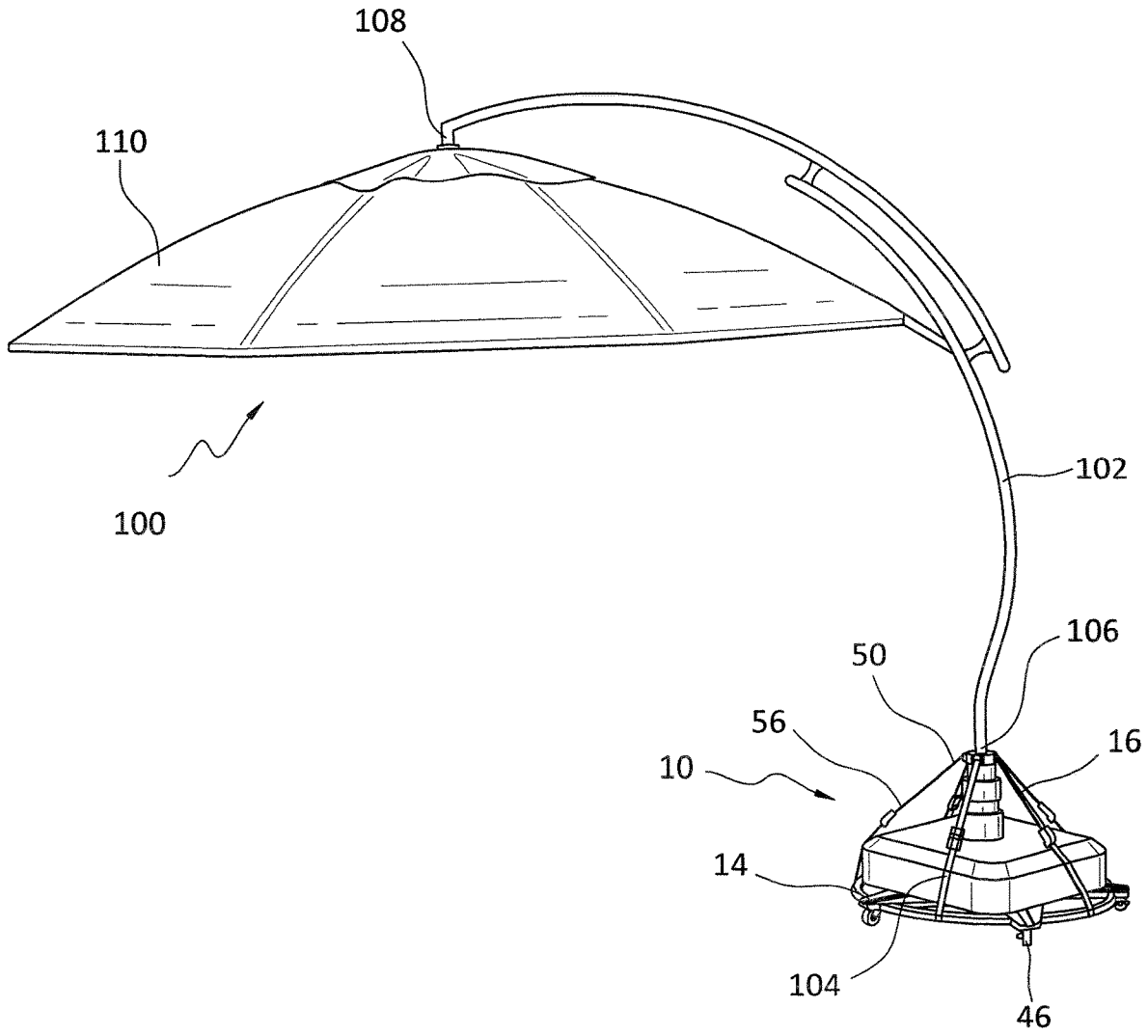
FIG. 2 is a right perspective view of the umbrella dolly.
Figure 3:
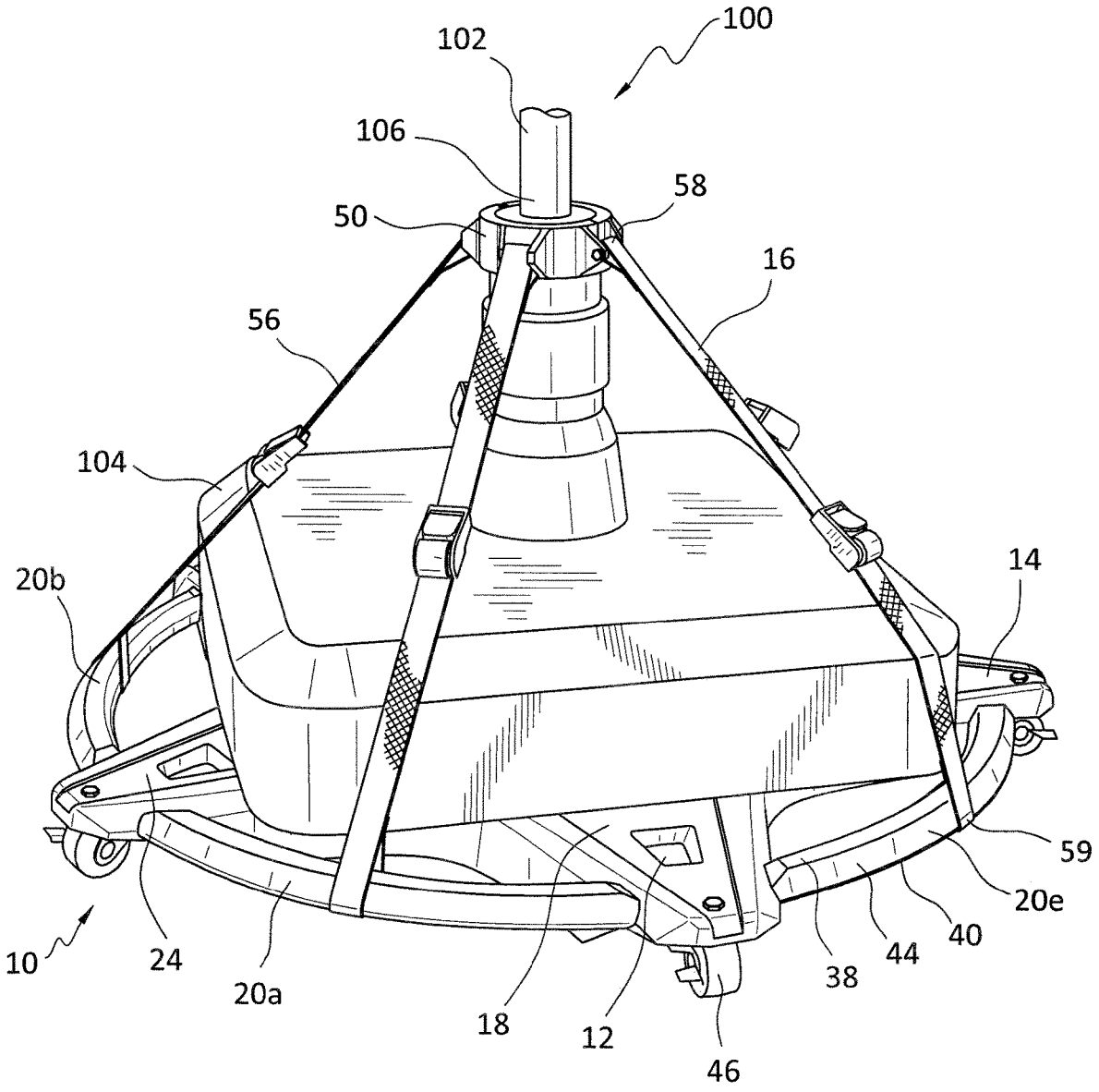
FIG. 3 is a detailed perspective view of the umbrella dolly.
Figure 4:
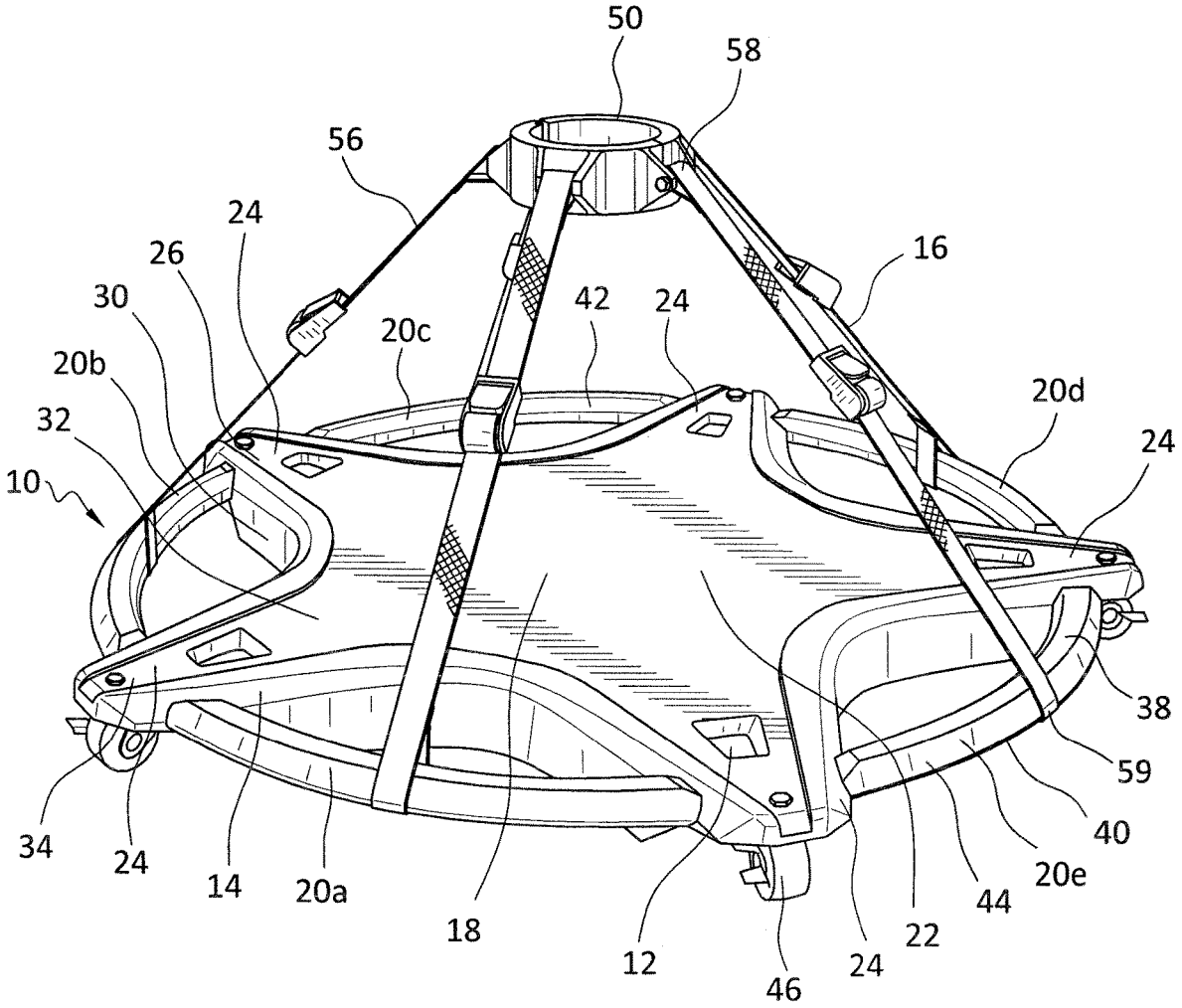
FIG. 4 is a detailed top perspective view of the umbrella dolly with the umbrella removed.
Figure 5:
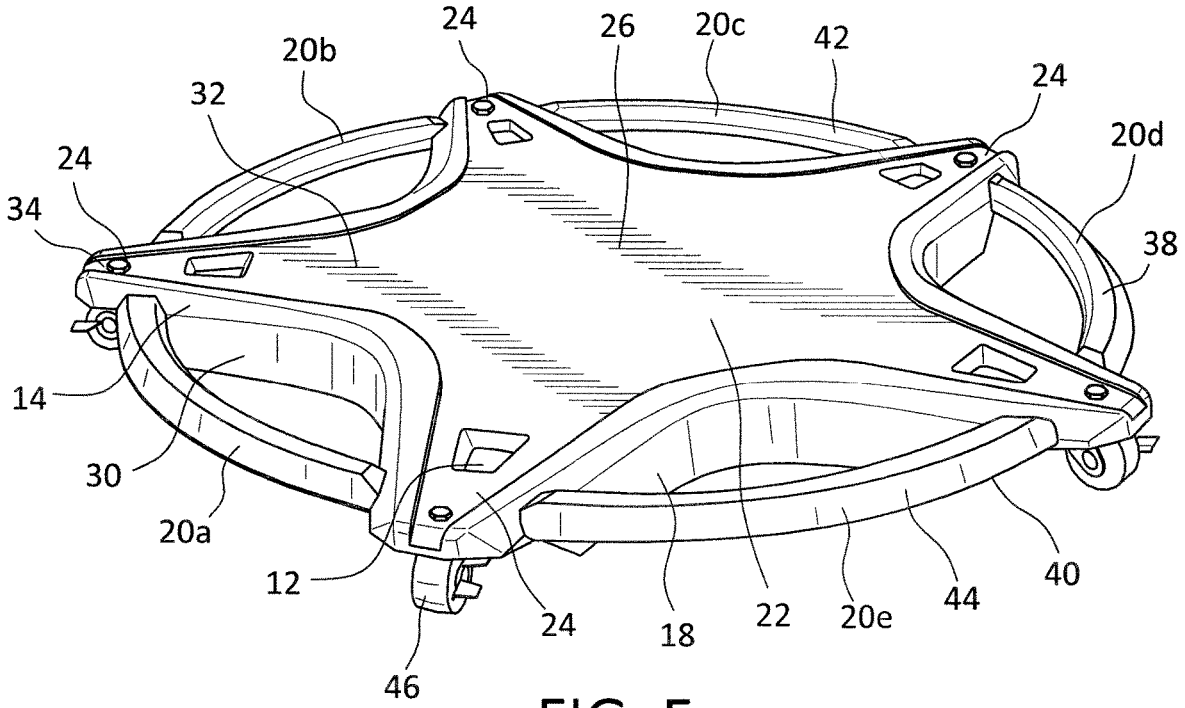
FIG. 5 is a detailed top perspective view of the umbrella dolly with the umbrella and retention assembly removed.
Figure 6:
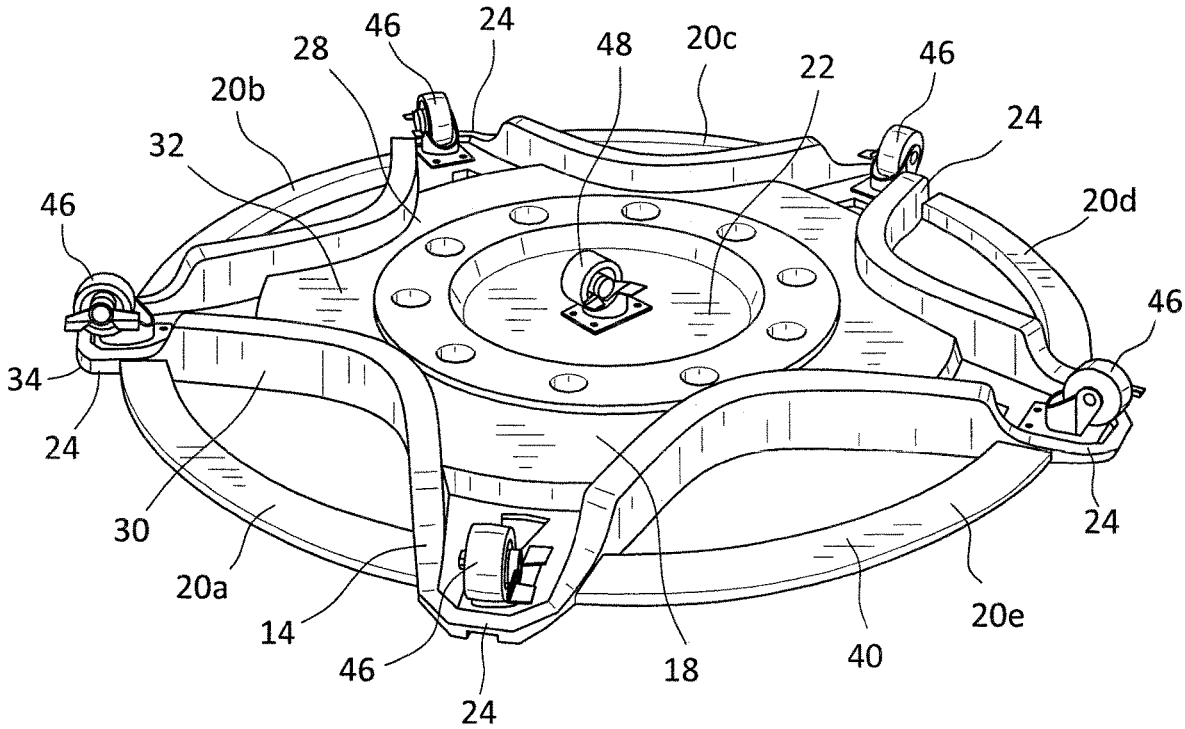
FIG. 6 is a detailed bottom perspective view of the umbrella dolly with the umbrella and retention assembly removed.
Figure 10:
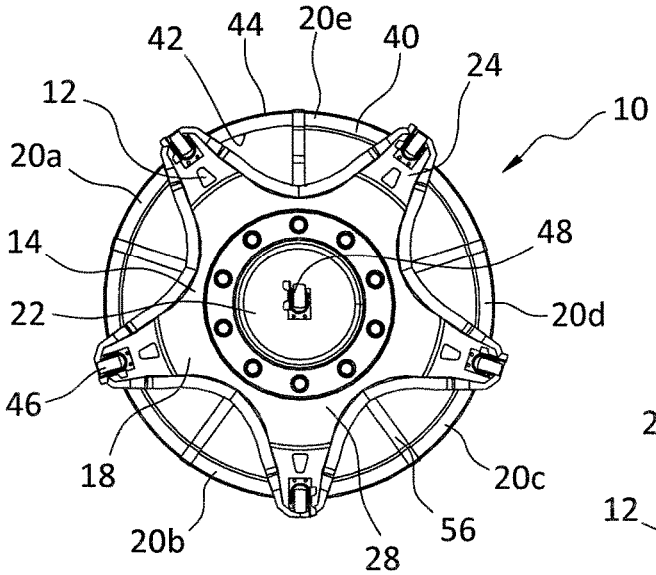
Figure 11:
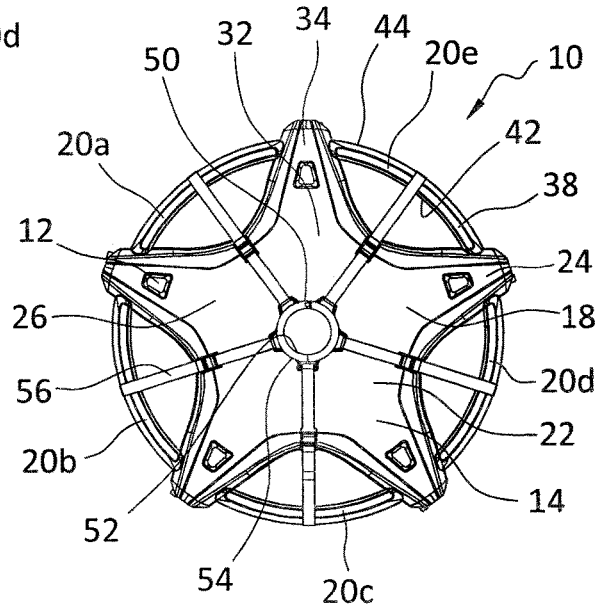

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

Referring to FIGS. 1 to 11, an embodiment of the umbrella dolly 10 in accordance with the present invention is disclosed. The embodiment of the umbrella dolly 10 disclosed with reference to FIGS. 1 to 11 is designed for a cantilever umbrella 100 and its weighted base, which are to be assembled on top of the umbrella dolly 10 itself. As those skilled in the art will appreciate, cantilever umbrellas 100 generally include a base 104 from which a pole 102 extends. The pole 102 is cantilevered and includes a first end 106 secured to the base 104 and a second end 108 to which the umbrella shade (or canopy) 110 is secured. The pole 102 is shaped such that the canopy 110 hangs at a position laterally offset from the base 104.

While the umbrella dolly disclosed above is particularly adapted for supporting and moving cantilevered umbrellas, it is appreciated the umbrella dolly could be similarly used in the support and movement of other types of umbrellas.

As will be appreciated based upon the following disclosure, existing umbrellas require disassembly and reassembly. The umbrella dolly 10 of the present invention is approximately 36 inches across and is built to support many hundreds of pounds and dynamic wind pressure. The umbrella dolly 10 is further provided with drain holes 12 (or drain slopes), as well as an anti-tip, anti-pull-out, and anti-wind-spin structures discussed below in detail.

More particularly, the umbrella dolly 10 includes a platform assembly 14 upon which the umbrella 100 sits when fully assembled and in use. In fact, the umbrella dolly 10 is constructed such that the umbrella and its base may be assembled on the platform assembly 14 of the umbrella dolly 10. The umbrella dolly 10 also includes a retention assembly 16 constructed to extend between the platform assembly 14 and the umbrella 100 in a manner providing additional support and ensuring that the umbrella 100 and platform assembly 14 are securely connected to enhance the stability of the umbrella 100 as it sits upon the umbrella dolly 10.

The platform assembly 14 includes a central support platform 18. The central support platform 18 includes a series of anchoring members 20*a*-20*e* for engagement with the retention assembly 16. As will be discussed below in greater detail and in accordance with a disclosed embodiment, the anchoring members 20*a*-20*e* are arcuate anchoring members extending between the support arms 24 of the central support platform 18. The arcuate anchoring members 20*a*-20*e* provide an anchoring point for attachment of the straps 56 of the retention assembly 16. The central support platform 18 includes a substantially circular central portion 22 from which a plurality of support arms 24, which have a triangular shape, extend. In accordance with a disclosed embodiment the central support platform 18 includes five (5) support arms 24. While five support arms are disclosed in the embodiment presented herein, it is appreciated four (4) or six (6), or some other number of support arms could be employed within the spirit of the present invention. Further, and as discussed below, the disclosed support arms 24 are substantially triangular shaped, although it is appreciated other shapes could be employed without departing from the spirit of the present invention. While the disclosed central support platform is of a particular shape, it is appreciated the shape thereof could be varied within the spirit of the present invention.

The central support platform 18 includes an upper surface 26, a lower surface 28, and a sidewall 30 extending between the upper surface 26 and the lower surface 28. Accordingly, each of the central portion 22 and the plurality of support arms 24 include respective upper surfaces, lower surfaces, and sidewalls. Further still, the central support platform 18 is of a one-piece construction and the central portion 22 and the plurality of support arms 24 are integrally formed.

Each of the plurality of support arms 24 includes a wide first end 32 coextensive with the central portion 22 and a narrow second end 34 at the apex of the triangle defined by the respective support arms 24. Secure attachment of each of the support arms 24 to the arcuate anchoring members 20*a*-20*e* is facilitated by integral molding of the arcuate anchoring members 20*a*-20*e* with the central support platform 18 such that the respective ends of each arcuate anchoring member 20*a*-20*e* are coextensive with side walls of respective support arms 24 adjacent the second end 34 thereof.

As briefly discussed above, each of the arcuate anchoring members 20*a*-20*e* defines an anchoring point for attachment of the retention assembly 16. Each of the arcuate anchoring members 20*a*-20*e* is constructed with a circular cross-sectional profile, although it is appreciated other cross-sectional profiles could be employed without departing from the spirit of the present invention. Each of the arcuate anchoring members 20*a*-20*e* includes an upper surface 38 and a lower surface 40. The upper and lower surfaces 38, 40 are connected by an interior side wall 42 and an exterior side wall 44. While the arcuate anchoring members 20*a*-20*e* disclosed herein are of an arcuate configuration, it is appreciated other shapes may be used without departing from the spirit of the present invention. It should also be appreciated that the anchoring members of the disclosed embodiment are secured to the support arms at a position slightly short of the tip thereof, and the connection point of the anchoring members to the support arms could be pushed radially outward to the very tip of the support arms.

The central support platform 18, in particular, the support arms 24, also includes a plurality of downwardly extending lockable caster wheels 46 secured to the lower surface 28 thereof. In accordance with a disclosed embodiment, five (5) caster wheels 46 are secured to the central support platform 18 at equidistant positions about the circumference of the central support platform 18. In accordance with a disclosed embodiment, the caster wheels 46 are positioned at the second ends 34 of the support arms 24. Four bolts are used to secure each caster to each support arm 24. By positioning the lockable swivel caster wheels 46 at the second ends 34 of the support arms 24, the lockable swivel caster wheels 46 extend the leverage point of the platform assembly 14, providing improved leverage and load distribution. The positioning of the lockable swivel caster wheels 46 at the second ends 34 of the support arms 24 also provides for ease of rolling. The lockable swivel caster wheels 46 are off-theshelf items and various types of caster wheels may be used without departing from the spirit of the present invention.

In an effort to provide additional support for the platform assembly 14 in the area under the center of the central support platform 18, at least one nonlocking swivel caster wheel 48 is secured to the lower surface 28 of the central portion 22. The nonlocking swivel caster wheel 48 extends between the lower surface of the central portion and the surface upon which the umbrella dolly 10 is positioned to provide additional support in the center of the platform assembly 14. While a single nonlocking swivel caster wheel 48 is disclosed herein, it is appreciated, a plurality of nonlocking swivel caster wheels could be employed without departing from the spirit of the present invention. The nonlocking swivel caster wheel 48 provides for additional support to address the span between the lockable swivel caster wheels 46 at the ends of the support arms 24 and weight of the umbrellas mounted upon the umbrella dolly 10, as well as wind forces that might be encountered by the umbrella 100 and the umbrella dolly 10.

In accordance with a disclosed embodiment, the central support platform 18 is constructed of molded plastic for strength, light weight, and low cost. As those skilled in the art will appreciate, the lower surface of the central support platform 18 may be constructed with a truss arrangement to enhance the strength of the central support platform 18. As to the arcuate anchoring members 20*a*-20*e*, they are also preferably constructed from molded plastic for strength, light weight, and low cost.

As mentioned above, the umbrella dolly 10 also includes a retention assembly 16 constructed to extend between the platform assembly 14 and the umbrella 100 in a manner providing additional support and ensuring that the umbrella 100 and platform assembly 14 are securely connected to enhance the stability of the umbrella 100 as it sits upon the umbrella dolly 10. The retention assembly 16 includes a collar member 50 shaped and dimensioned for secure attachment to the upwardly extending pole 102 of the umbrella 100 in the area adjacent to the base 104 of the umbrella 100 and the platform assembly 14. The collar member 50 is constructed such that it is annular and includes an inner surface 52 that directly engages the pole 102 of the umbrella 100 and an outer surface 54 facing away from the pole 102 of the umbrella 100.

Figure 12:
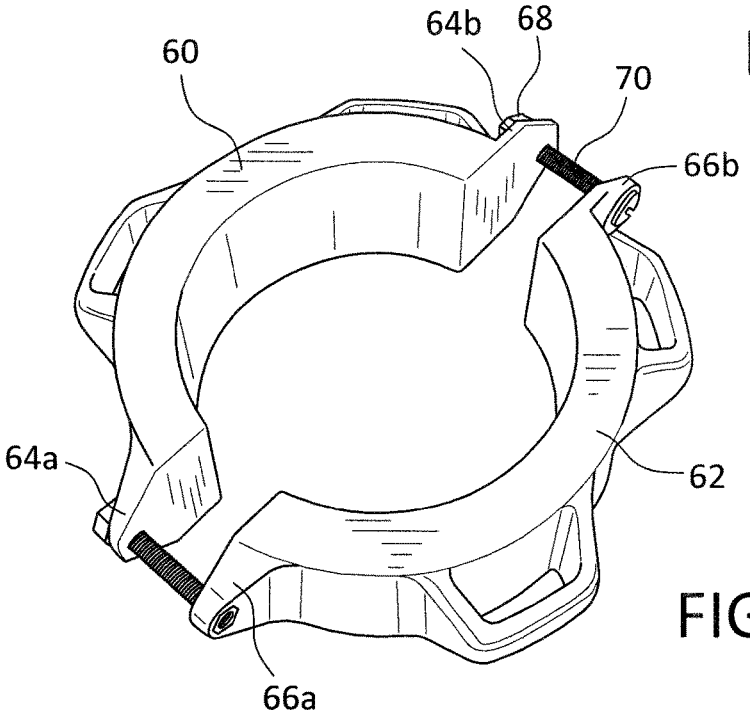
FIG. 12 is a perspective view of an alternate embodiment of the collar member.

The collar member 50 includes arcuate first and second collar segments 60, 62. Each of the first and second collar segments 60, 62 is provided with opposed end members 64*a*, 64*b*, 66*a*, 66*b* that mate with respective end members 64*a*, 64*b*, 66*a*, 66*b* of the other collar segment 60, 62 when the first and second collar segments 60, 62 are positioned about the pole 102 of the umbrella 100. The opposed first end members 64*a*, 66*a* of the first and second collar segment 60, 62 are provided with respective nut 68 and bolt 70, while the opposed second end members 64*b*, 66*b* of the first and second collar segment 60, 62 are connected by a hinge 71. The opposed first end members 64*a*, 66*a* of the first and second collar segment 60, 62 are drawn together under the control of the nut and bolt 68, 70 that extend between the first end members 64*a*, 66*a* of the collar segments 60, 62. D-rings 72 are secured to the outer surface 54 of the first and second collar segments 60, 62 and provide a mounting structure for the straps 56 of the retention assembly 16. While a hinge 71 is disclosed above, it is appreciated the opposed second end members 64*b*', 66*b*' of the first and second collar segment 60', 62' could be connected by a nut and bolt 68', 70' arrangement similar to that disclosed in conjunction with the opposed first end members 64*a*', 66*a*' (see FIG. 12). In order to allow for attachment of five (5) straps 56 between the arcuate anchoring members 20*a*-20*e* and the collar member 50, the D-ring straddling the first and second collar segments 60, 62 at the first end members 64*a*, 66*a* is formed in two parts that are drawn together when the first end member 64*a*, 66*a* are brought together. It is also contemplated that the first and second collar segments could be of different lengths such that two D-rings may be secured to the first collar segment and three D-rings may be secured to the second collar segment. As briefly discussed above, it is important that the collar member 50 securely engage the pole 102 of the umbrella 100 and the inner surface 52 of the collar member 50 is of a diameter similar to, and slightly smaller than, the diameter of the pole 102 of the umbrella 100. Further friction between the collar member 50 and the pole 102 of the umbrella 100 may be achieved by positioning a rubber insert between the collar member 50 and the pole 102 of the umbrella 100.

As briefly discussed above, the retention assembly 16 further includes a plurality of nylon straps 56 extending from the outer surface 54 of the collar member 50. Each of the plurality of straps 56 includes a first end 58 secured to the collar member 50 and a second end 59 adapted for attachment to, and adjustment relative to, the arcuate anchoring members 20*a*-20*e*. The first ends 58 of each of the plurality of straps 56 are secured to D-rings 72 extending from the outer surface 54 of the collar member 50. Each of the straps 56 includes a mechanism that allows the effective length of the strap 56 to be selectively shortened to pull the collar member 50 down toward the platform assembly 14 and hold the base 104 of the umbrella 100 securely in place. The mechanism shown in the disclosed embodiment is generically a length adjustment buckle 78 of any of a variety of commonly available constructions. For example, it could be a ratcheting buckle or a spring-loaded buckle commonly used with lashing straps. In accordance with other embodiments, the straps could be replaced with conventional bungee cords. The straps could also constructed from a single strap member with a first end having a spring-biased buckle and a free second end shaped and dimensioned to pass through the buckle, wherein the free second end of the strap member is passed about the anchoring member, through the D-ring, and is then passed through and locked relative to the buckle to adjust the length of the strap extending between the collar member and the anchoring member. While spring-biased buckles are disclosed above, it is appreciated various buckle arrangements could be used in accordance with the present invention.

In practice, the base 104 of the umbrella 100 is positioned upon the platform assembly 14. Thereafter, the umbrella 100 may be assembled in accordance with the manufacturer's instructions. The retention assembly 16 is then secured between pole 102 of the umbrella 100 and the arcuate anchoring members 20*a*-20*e*.

With the umbrella dolly 10, moving the umbrella 100 around a deck is simple. Simply push or pull the entire umbrella 100 next to the picnic table, the chaise lounges, or even the pool. Simply engage the locks of the caster wheels 46 and the umbrella 100 stays put until you decide to move it again. The customer gets much more use from their investment and there is no deck staining from an immovable base 104. The umbrella 100 can simply and safely be moved out of the way when not in use.

The umbrella dolly 10 provides anti-tip technology by enhancing leverage to lower the incidence of dangerous tipping of the umbrella 100 in wind (although users are encouraged to retract the umbrella 100 when not in use or in strong winds). Further, the umbrella dolly 10 including its caster wheels 46 extending beyond the limits of the umbrella's base 104 to provide increased leverage against tipping. This may make the umbrella 100 even more stable than if the base 104 was just sitting on the deck. The retention assembly 16 includes a collar member 50 bolted around the main umbrella pole 102 with hooks for heavy-duty straps to connect to the retention assembly 16 at each wheel location. This lessens tilting in a breeze because the entire system becomes one unit and the windward side of the base 104 requires more force to tilt. This too provides greater safety and security than the original umbrellas and bases just sitting on a deck; as commonly available umbrellas have a tendency to tilt. Initial testing reveals that it takes nearly double the force to tilt an umbrella 100 on an umbrella dolly 10.

The same anti-tip technology of the umbrella dolly 10 will greatly reduce the dangerous incidence of an umbrella pole 102 being lifted out of its base 104 by an updraft force because the pole 102 is "tied" to the weighted base and umbrella dolly 10 using the retention assembly 16.

Cantilever umbrellas often spin from a breeze like a weathervane. The combination of the retention assembly 16 and lockable caster wheels 48 prevent this spin. The umbrella 100 stays where you want it and shades where you want it.

Heavy umbrella bases 104 sitting forever on a deck make the area very difficult to clean well. Dirt and rot under the base 104 create a terrible stain which will be revealed when the umbrella base 104 is removed in the future. The umbrella dolly 10 sits on caster wheels so that the deck underneath the base 104 is open and with the ability to move the umbrella 100 for deck cleaning via the umbrella dolly 10, the deck remains clean and unstained.

As briefly mentioned above, the standard umbrella dolly 10 has a diameter of 36 inches to accommodate most large cantilever umbrella bases. The umbrella dolly 10 has wheels around the exterior, but also under the center to accommodate many hundreds of pounds of weight and pressure, and the spans between the wheels.

While the preferred embodiments have been shown and described, it will be understood that there is no intent to limit the invention by such disclosure, rather, is intended to cover all modifications and alternate constructions falling within the spirit and scope of the invention.

The invention claimed is:

1. An umbrella dolly for use with a cantilever umbrella, comprising:

a platform assembly, wherein the platform assembly includes a central support platform including a substantially circular central portion from which a plurality of support arms, which have a triangular shape, extend, each of the plurality of arms extends radially outwardly from the central platform and each of the plurality of support arms includes a first end coextensive with the central portion and a second end; and a retention assembly constructed to extend between the platform assembly and the umbrella in a manner providing additional support and ensuring that the umbrella and platform assembly are securely connected to enhance stability of the umbrella as it sits upon the umbrella dolly;

wherein the central support platform includes a series of anchoring members for engagement with the retention assembly, the series of anchoring members extending between respective second ends of the support arms.

2. The umbrella dolly according to claim 1, wherein the central support platform includes a plurality of downwardly extending lockable caster wheels secured to the lower surface thereof.

3. The umbrella dolly according to claim 2, wherein at least one nonlocking swivel caster wheel is secured to the lower surface of the central support platform.

4. The umbrella dolly according to claim 1, wherein the first end of each of the plurality of support arms is wide and coextensive with the central portion and the second end of each of the plurality of support arms is narrow at an apex of the triangle defined by the respective support arms.

5. The umbrella dolly according to claim 1, wherein the respective ends of each anchoring member are coextensive with side walls of respective support arms adjacent the second end thereof.

6. The umbrella dolly according to claim 1, wherein the central support platform includes five support arms.

7. The umbrella dolly according to claim 1, wherein each of the anchoring members includes an upper surface and a lower surface, wherein the upper and lower surfaces are connected by an interior side wall and an exterior side wall.

8. The umbrella dolly according to claim 1, wherein the retention assembly includes a collar member shaped and dimensioned for secure attachment to an upwardly extending pole of the umbrella in an area adjacent to a base of the umbrella and the platform assembly.

9. The umbrella dolly according to claim 8, wherein the collar member is annular and includes an inner surface that directly engages the pole of the umbrella and an outer surface facing away from the pole of the umbrella.

10. The umbrella dolly according to claim 9, wherein the collar member includes arcuate first and second collar segments, each of the first and second collar segments is provided with opposed end members that mate with respective end members of the other collar segment when the first and second collar segments are positioned about the pole of the umbrella.

11. The umbrella dolly according to claim 8, wherein the retention assembly further includes a plurality of straps extending from an outer surface of the collar member.

12. The umbrella dolly according to claim 8, wherein the retention assembly further includes a plurality of straps extending from an outer surface of the collar member.

13. The umbrella dolly according to claim 1, wherein the anchoring members are arcuate anchoring members extending between support arms of the central support platform, the arcuate anchoring members provide an anchoring point for attachment of straps of the retention assembly.

14. An umbrella dolly for use with a cantilever umbrella, comprising:

a platform assembly, wherein the platform assembly includes a central support platform including a series of anchoring members for engagement with a retention assembly and the central support platform includes a substantially circular central portion from which a plurality of support arms, which have a triangular shape, extend, each of the plurality of support arms includes a wide first end coextensive with the central portion and a narrow second end at an apex of thereof; and a retention assembly constructed to extend between the platform assembly and the umbrella in a manner providing additional support and ensuring that the umbrella and platform assembly are securely connected to enhance stability of the umbrella as it sits upon the umbrella dolly.

15. The umbrella dolly according to claim 14, wherein the first end of each of the plurality of support arms is wide and coextensive with the central portion and the second end of each of the plurality of support arms is narrow at an apex of the triangle defined by the respective support arms.

16. The umbrella dolly according to claim 14, wherein the central support platform includes a plurality of downwardly extending lockable caster wheels secured to the lower surface thereof.

17. The umbrella dolly according to claim 16, wherein at least one nonlocking swivel caster wheel is secured to the lower surface of the central support platform.

18. The umbrella dolly according to claim 14, wherein the central support platform is of a one-piece construction.

19. The umbrella dolly according to claim 14, wherein the anchoring members are arcuate anchoring members extending between support arms of the central support platform, the arcuate anchoring members provide an anchoring point for attachment of straps of the retention assembly.

20. The umbrella dolly according to claim 14, wherein the retention assembly includes a collar member shaped and dimensioned for secure attachment to an upwardly extending pole of the umbrella in an area adjacent to a base of the umbrella and the platform assembly.

21. The umbrella dolly according to claim 20, wherein the collar member is annular and includes an inner surface that directly engages the pole of the umbrella and an outer surface facing away from the pole of the umbrella.

22. The umbrella dolly according to claim 21, wherein the collar member includes arcuate first and second collar segments, each of the first and second collar segments is provided with opposed end members that mate with respective end members of the other collar segment when the first and second collar segments are positioned about the pole of the umbrella.

23. The umbrella dolly according to claim 20, wherein the retention assembly further includes a plurality of straps extending from an outer surface of the collar member.

24. A umbrella dolly for use with a cantilever umbrella, comprising:

a platform assembly including a central support platform, the central support platform also includes a substantially circular central portion from which a plurality of support arms, which have a triangular shape, extend, each of the plurality of support arms includes a wide first end coextensive with a central portion and a narrow second end at an apex of a triangle defined by the respective support arms, and a retention assembly constructed to extend between the platform assembly and the cantilever umbrella in a manner providing additional support and ensuring that the cantilever umbrella and platform assembly are securely connected to enhance stability of the cantilever umbrella as it sits upon the umbrella dolly, wherein the central support platform includes a series of anchoring members for engagement with the retention assembly wherein respective ends of each anchoring member are coextensive with sidewall of support arms adjacent the second end thereof.

25. An umbrella dolly for use with a cantilever umbrella, comprising:

a platform assembly, wherein the platform assembly includes a central support platform including includes a series of anchoring members for engagement with a retention assembly and the anchoring members are arcuate anchoring members extending between support arms of the central support platform, the arcuate anchoring members provide an anchoring point for attachment of straps of the retention assembly; and wherein the retention assembly is constructed to extend between the platform assembly and the umbrella in a manner providing additional support and ensuring that the umbrella and platform assembly are securely connected to enhance stability of the umbrella as it sits upon the umbrella dolly.

26. The umbrella dolly according to claim 25, wherein the central support platform includes a plurality of downwardly extending lockable caster wheels secured to the lower surface thereof.

27. The umbrella dolly according to claim 26, wherein at least one nonlocking swivel caster wheel is secured to the lower surface of the central support platform.

28. The umbrella dolly according to claim 25, wherein the retention assembly includes a collar member shaped and dimensioned for secure attachment to an upwardly extending pole of the umbrella in an area adjacent to a base of the umbrella and the platform assembly.

29. The umbrella dolly according to claim 28, wherein the collar member is annular and includes an inner surface that directly engages the pole of the umbrella and an outer surface facing away from the pole of the umbrella.

30. The umbrella dolly according to claim 29, wherein the collar member includes arcuate first and second collar segments, each of the first and second collar segments is provided with opposed end members that mate with respective end members of the other collar segment when the first and second collar segments are positioned about the pole of the umbrella.

31. The umbrella dolly according to claim 30, wherein the retention assembly further includes a plurality of straps extending from an outer surface of the collar member.

* * * * *